US007380884B2

(12) United States Patent
Matern et al.

(10) Patent No.: US 7,380,884 B2
(45) Date of Patent: Jun. 3, 2008

(54) SWITCHING APPARATUS

(75) Inventors: Gerard J. Matern, Waterloo (CA); Arthur A. Patton, Waterloo (CA)

(73) Assignee: Leggett & Platt Ltd., Waterloo, Ontario (CA)

( * ) Notice: Subject to any disclaimer, the term of this patent is extended or adjusted under 35 U.S.C. 154(b) by 247 days.

(21) Appl. No.: 10/696,080

(22) Filed: Oct. 29, 2003

(65) Prior Publication Data

US 2005/0093345 A1 May 5, 2005

(51) Int. Cl.
*B60N 2/02* (2006.01)
*B60N 2/48* (2006.01)

(52) U.S. Cl. ..... 297/374; 297/364; 297/363

(58) Field of Classification Search ..... 74/10.6, 74/838, 54, 55, 497, 107; 297/71, 374, 301.1, 297/301.4, 354.12, 363, 364
See application file for complete search history.

(56) References Cited

U.S. PATENT DOCUMENTS

| | | | | |
|---|---|---|---|---|
| 1,893,217 | A * | 1/1933 | Babitch | 74/53 |
| 4,373,692 | A | 2/1983 | Knoblauch et al. | 248/162.1 |
| 5,356,200 | A | 10/1994 | Stumpf et al. | 297/328 |
| 5,588,706 | A * | 12/1996 | Neumueller et al. | 297/374 |
| 5,676,425 | A * | 10/1997 | Pernicka | 297/374 |
| 5,676,706 | A * | 10/1997 | Akram et al. | 8/416 |
| 5,863,099 | A * | 1/1999 | Hancock | 297/374 |
| 6,116,695 | A | 9/2000 | Heidmann et al. | 297/463.1 |
| 6,174,031 | B1 | 1/2001 | Lindgren et al. | 297/463.1 |
| 6,193,314 | B1 | 2/2001 | Chiang | 297/301.7 |
| 6,213,552 | B1 * | 4/2001 | Miotto | 297/300.5 |
| 6,224,155 | B1 | 5/2001 | DeKraker et al. | 297/344.12 |
| 6,394,550 | B1 * | 5/2002 | Liu | 297/374 |
| 6,467,845 | B1 * | 10/2002 | Chen | 297/374 |
| 2003/0001417 | A1 * | 1/2003 | Moreschi | 297/300.5 |

* cited by examiner

*Primary Examiner*—Richard W L Ridley
*Assistant Examiner*—Justin Krause
(74) *Attorney, Agent, or Firm*—Shook, Hardy & Bacon, L.L.P.

(57) ABSTRACT

The present invention provides a switching apparatus having a design intended to reduce wear on its key part. In an embodiment of the invention, a rotatable member is rotatably fixed on a pivot. A slidable bearing member has a first surface for engaging the rotatable member in a non-sliding manner, and an opposite second surface for slidingly engaging an abutment. Any significant wear on the switching apparatus is more likely to occur between the sliding member and the abutment, rather than between the rotatable member and the sliding member. In an embodiment, one of the rotatable member and the slidable bearing member includes a protuberance, and the other of the rotatable member and the slidable bearing member includes a corresponding indentation for engagement with the protuberance. The join formed between the protuberance and indentation provides a substantially non-sliding engagement between the rotatable member and the slidable bearing member.

28 Claims, 8 Drawing Sheets

SWITCHING APPARATUS

BACKGROUND OF THE INVENTION

The present invention relates to a switching apparatus for selectively engaging and disengaging a mechanism.

Chairs are known to have adjustment mechanisms for their various adjustable parts. For example, an angle a backrest makes with reference to a chair seat may be adjustable by an adjustment mechanism provided between the backrest and the seat. Similarly, the angle that the chair seat makes with reference to a seat support (and thus the floor) may be adjustable by an adjustment mechanism provided between the seat and the seat support. In order to control such adjustment mechanisms, a user operable switching apparatus may be provided.

A switching apparatus may employ a cam rotatable about a pivot by means of a handle. An example of such a switching apparatus is shown in U.S. Pat. No. 5,356,200 to Stumpf et al. In certain designs, the cam must bear a significant amount of force and, over time, the cam face may wear down. Excessive wear on the cam face may result in loosening of parts and early breakdown of the switching apparatus. It is thus desirable to design a mechanism with reduced mechanical wear on its key parts. U.S. Pat. No. 5,676,425 to Pernicka and U.S. Pat. No. 6,394,550 to Liu attempt to address this issue with a bearing plate against which the cam bears. However, the problem of cam wear remains.

SUMMARY OF THE INVENTION

The present invention provides a switching apparatus having a design intended to reduce wear on its key part. In an embodiment of the invention, a rotatable member is rotatably fixed on a pivot. A slidable bearing member has a first surface for engaging the rotatable member in a non-sliding manner, and an opposite second surface for slidingly engaging an abutment. Any significant wear on the switching apparatus is more likely to occur between the slidable bearing member and the abutment, rather than between the rotatable member and the slidable bearing member.

In an embodiment, one of the rotatable member and the slidable bearing member includes a protuberance, and the other of the rotatable member and the slidable bearing member includes a corresponding indentation for engagement with the protuberance. The join formed between the protuberance and indentation provides a substantially non-sliding engagement between the rotatable member and the slidable bearing member.

In an embodiment, the rotatable member may comprise a cam having first and second cam faces for defining first and second rotational positions. The slidable bearing member may comprise a slidable bearing plate having first and second edge stops for defining its sliding limits.

BRIEF DESCRIPTION OF THE DRAWINGS

In the figures which illustrate example embodiments of this invention.

DETAILED DESCRIPTION

Figure 1:
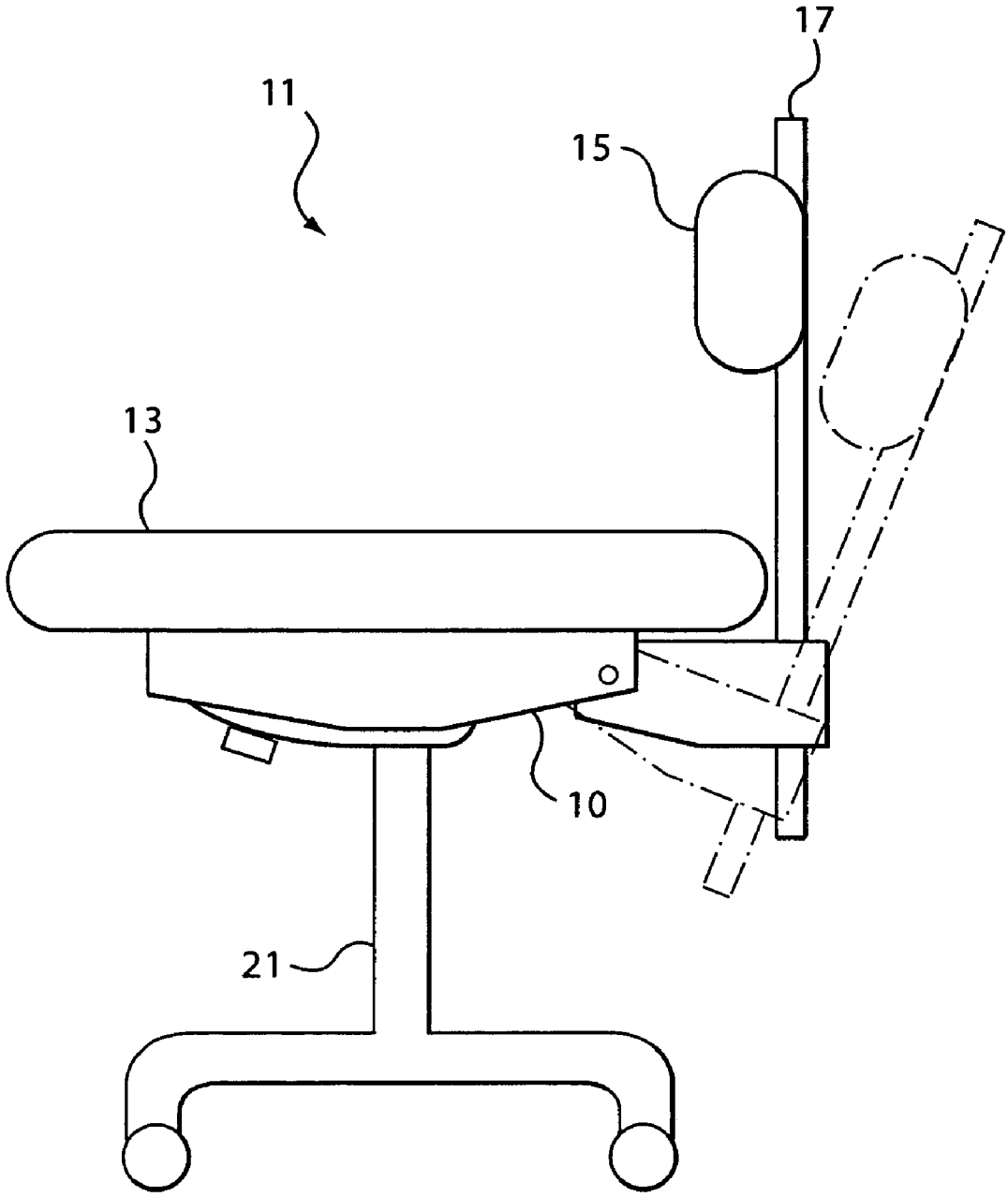
FIG. 1 is a schematic side view of a chair embodying the subject invention.

Referring to FIG. 1, a chair 11 comprises a chair seat 13 and a backrest 15 supported on a backrest support bar 17. The chair seat 13 and backrest support bar 17 are mounted to a chair adjustment mechanism 10 which may be used for adjusting the angle of the backrest 15 (backrest support bar 17) relative to the seat 13.

Figure 1A:
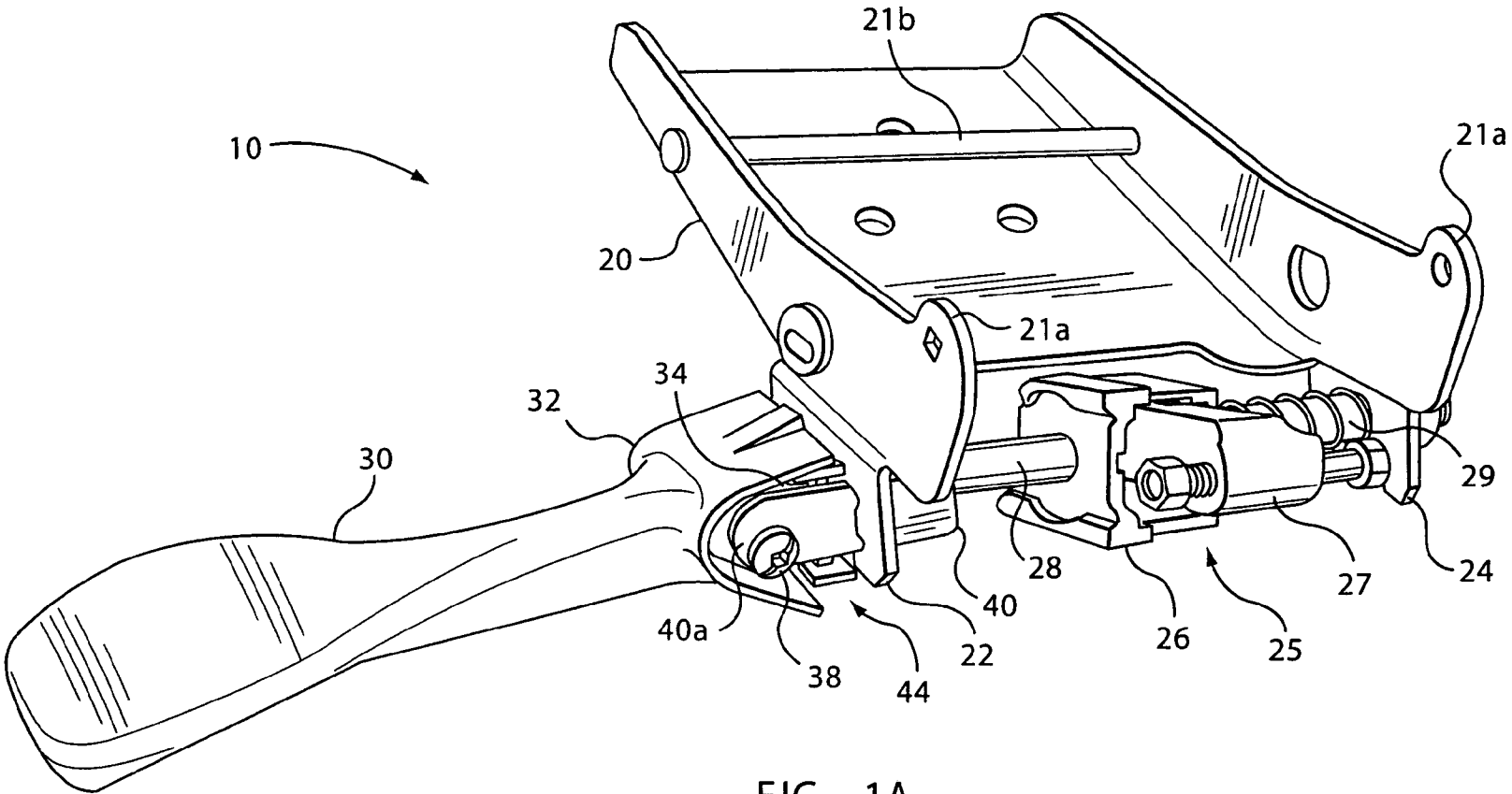
FIG. 1*a* is a chair adjustment mechanism embodying the subject invention.

Referring to FIG. 1*a*, chair adjustment mechanism 10 includes a chair seat bracket 20 having mounting flanges 21*a* and a mounting rod 21*b* for facilitating connection of the seat bracket 20 to other chair adjustment mechanism components (not shown). The seat bracket 20 has first and second support walls 22, 24 for mounting an adjustment assembly, such as a locking assembly 25, therebetween. The locking assembly 25 may comprise, for example, a slidable base 26 and a transversely mounted adjustment arm 27 which may be selectively engaged and disengaged from the slidable base 26. In the present illustrative embodiment, a first tubular spacer 28 maintains a fixed distance between the slidable base 26 of locking assembly 25 and a stirrup-shaped bracket 40, and a second tubular spacer 29 maintains a minimum distance between the slidable base 26 of locking assembly 25 and the second support wall 24. The stirrup-shaped bracket 40, which passes through slots in the first support wall 22, has a compression function, as described further below.

Figure 1B:
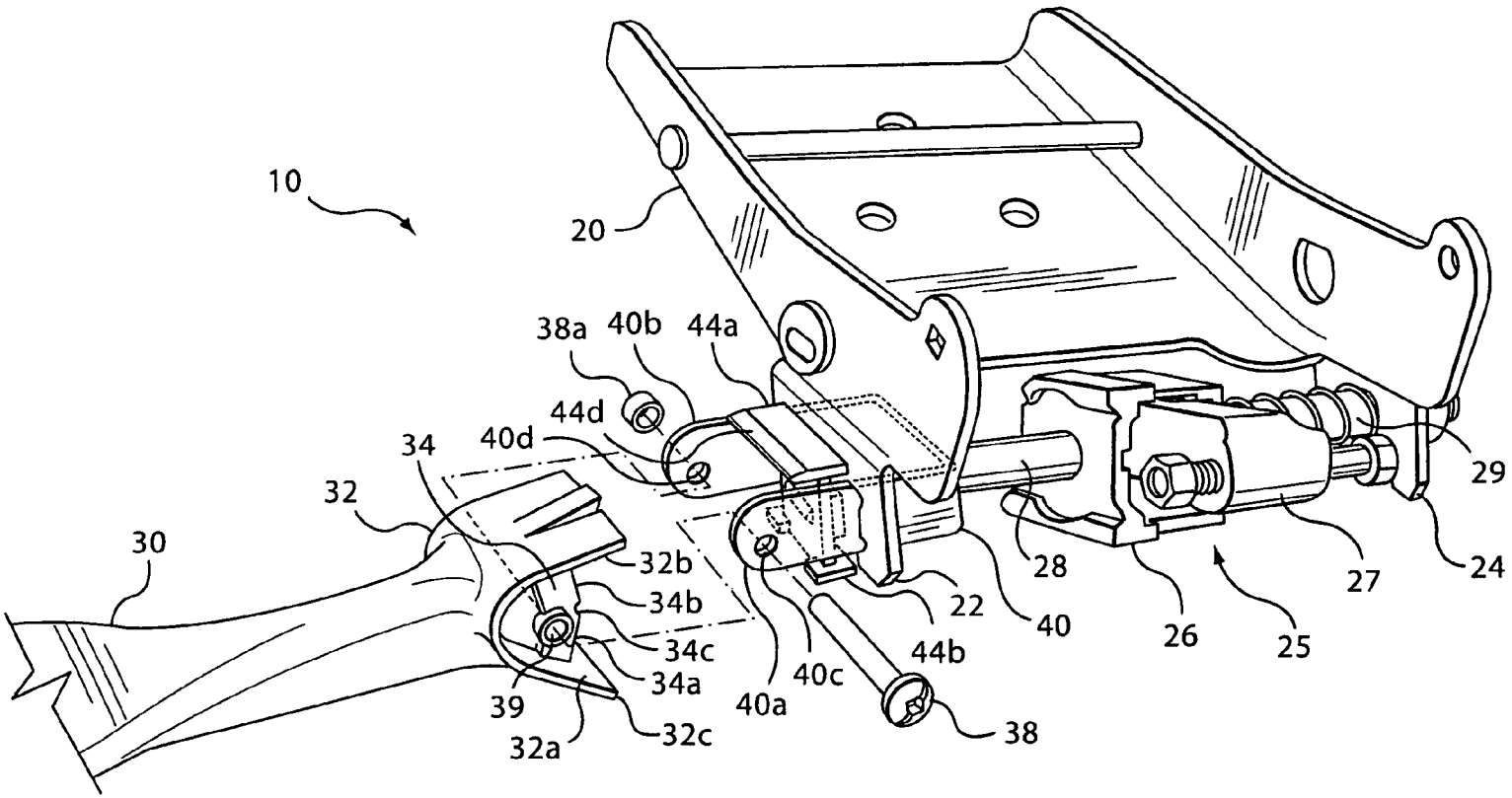
FIG. 1*b* is a partially exploded view of the chair adjustment mechanism of FIG. 1*a*.
Figure 1C:
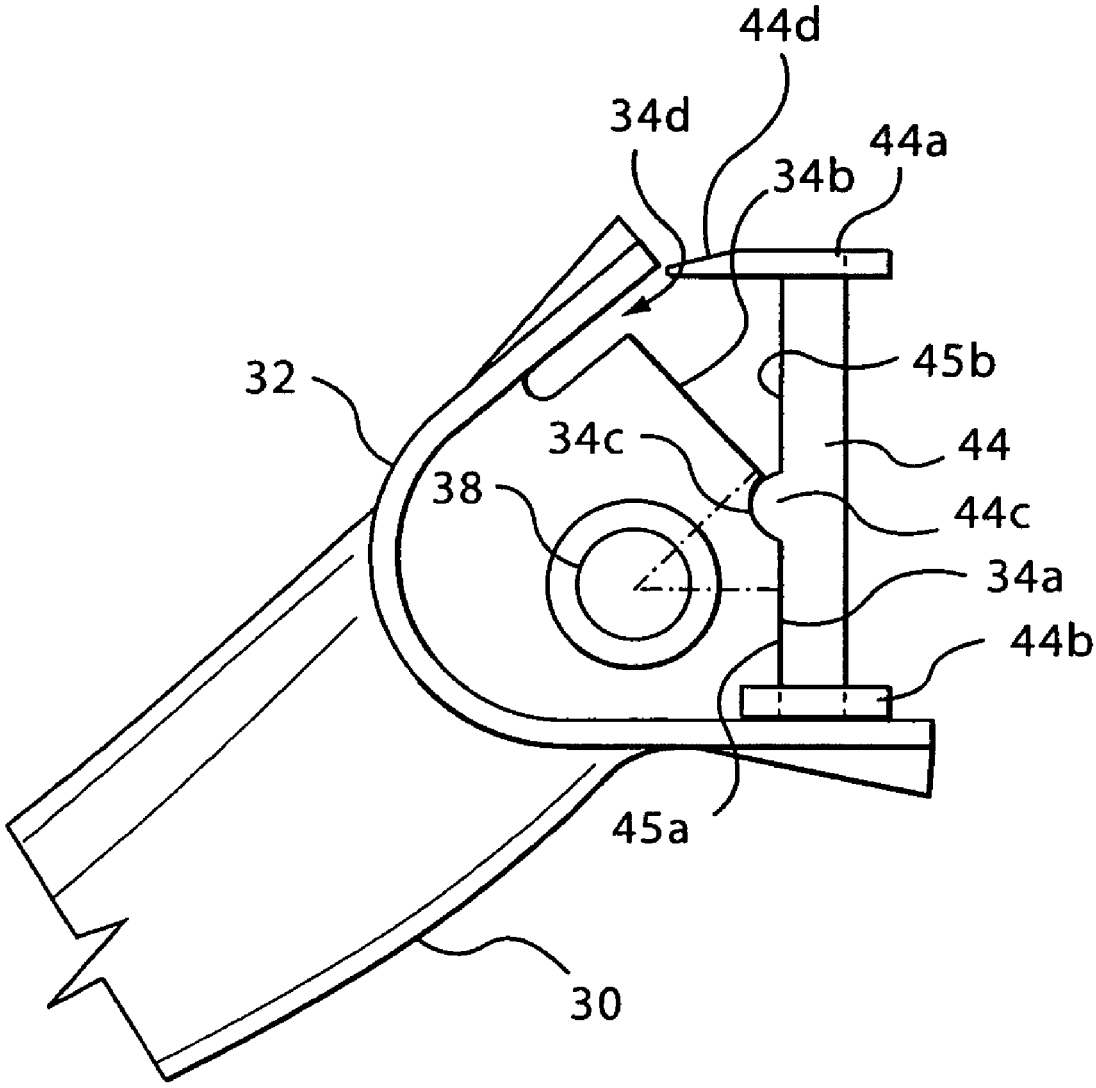
FIG. 1*c* is a detailed view of an embodiment of a switching apparatus made in accordance with the subject invention.

Referring to FIG. 1*b* (which shows the chair adjustment mechanism 10 of FIG. 1*a* in a partially exploded view to provide the details of the switching apparatus) and FIG. 1*c*, a pin 38 passes in and through bores 40*c*, 40*d* in the first and second arms 40*a*, 40*b* of the stirrup-shaped bracket 40, and in and through a bore 39 in the base 32 of handle 30 in order to pivotally mount the handle 30 between the first and second arms 40*a*, 40*b* of the stirrup-shaped bracket 40.

As shown in FIG. 1*c*, handle base 32 has a rotatable member or cam 34 that includes a first cam face 34*a* and a second cam face 34*b*. In the present illustrative embodiment, there is an indentation or notch 34*c* in the nose or apex of the cam 34, between the first and second cam faces 34*a*, 34*b*. The purpose of the notch 34*c* is explained further below.

In the present illustrated embodiment, a bearing plate 44 includes a first flanged edge 44*a* and a second flanged edge 44*b*. As shown, flanged edge 44*a* may have a suitably shaped flanged extension 44*d* which extends generally towards the second cam face 34*b*. A recess 34*d* in the second cam face 34*b* is sized to receive extension 44*d* when the second cam face 34*b* engages the bearing plate 44. As will become apparent from FIG. 2*a* and FIG. 2*b*, below, the flanged extension 44*d* may help guard against accidental pinching during operation of the chair adjustment mechanism 10.

The bearing plate 44 is suitably dimensioned such that the bearing plate 44 is slidable between the first and second arms 40*a*, 40*b* of the stirrup-shaped bracket 40, to the extent that the first flanged edge 44*a* and the second flanged edge 44*b* allow. As shown in FIG. 1*b*, the first and second flanged edges 44*a*, 44*b* may be dimensioned to act as stops by abutting an edge (the top edge or bottom edge) of the first and second arms 40*a*, 40*b* of the stirrup-shaped bracket 40. Bearing plate 44 perpetually engages cam 34 as detailed below.

Figure 2A:
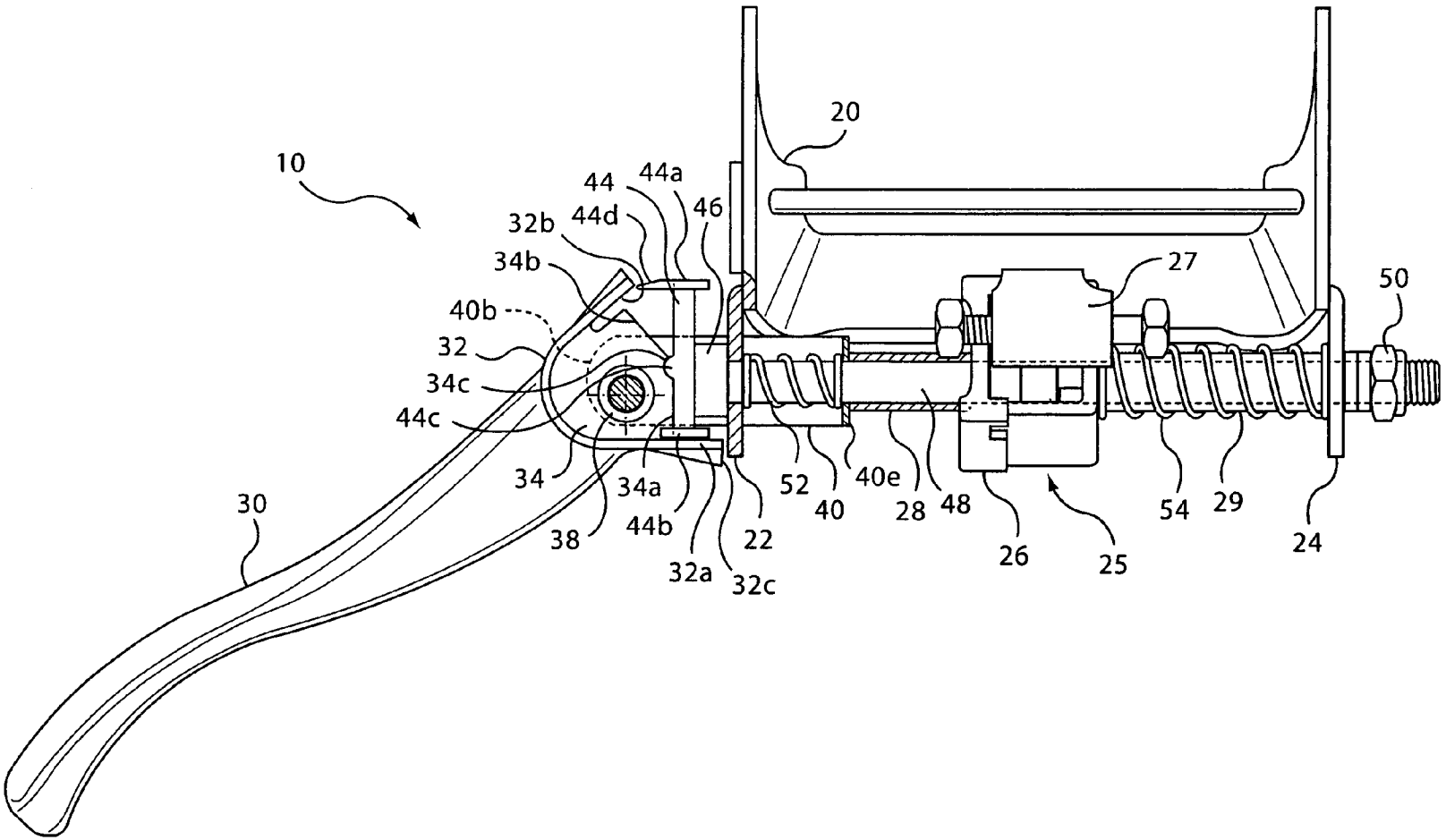
FIG. 2*a* is a front elevation of the chair adjustment mechanism of FIG. 1*a* in a first position.

Now referring to FIG. 2*a* along with FIG. 1*b* and FIG. 1*c*, with bearing plate 44 engaging cam 34, a nose or protuberance 44*c* of the bearing plate engages the notch 34*c* in the cam 34. When handle 30 is in a first position as shown, first cam face 34*a* engages a first cam receiving surface 45*a* of bearing plate 44. As shown in FIG. 2*a*, when handle 30 is moved into the first position, the engagement between the nose or protuberance 44*c* of the bearing plate 44 and the notch 34*c* of the cam 34 slides the bearing plate 44 into its uppermost position between the first and second arms 40*a*, 40*b* of the stirrup-shaped bracket 40. Also, as shown, the flanged extension 44*d* substantially guards any gap between the bearing plate 44 and the engaging cam 34 to help prevent pinched fingers.

The bearing plate 44 is shown engaging an abutment 46 (FIG. 2*a*) which, in the present illustrative embodiment, comprises the enlarged head of shaft 48. Shaft 48 bridges the first and second support walls 22, 24 and may be secured in position by a lock nut 50. The stirrup-shaped bracket 40 has a central opening (not shown) which receives shaft 48 with a suitable clearance allowing free movement. Encircling the shaft 48 and located adjacent to the first support wall 22 is a first coil spring 52. As shown in FIG. 2*a*, coil spring 52 is in compression and biases a base 40*e* of the stirrup-shaped bracket 40 away from the first support wall 22 and against tube 28. This urges tube 28, and slidable base 26 toward support wall 24.

As the first and second arms 40*a*, 40*b* of the stirrup-shaped bracket 40 are pinned by pin 38 to base 32 of handle 30, the first coil spring 52 thus also acts to urge cam 34 against the bearing plate 44, and the bearing plate 44 against the abutment 46. Thus, the stirrup-shaped bracket 40 has a compression function, and is hereafter referred to as compression member 40. A second coil spring 54 encircling shaft 48 acts opposite to the first coil spring 52 and biases the slidable base 26 of locking assembly 25 away from the second support wall 24. The first coil spring 52 is stronger than the second coil spring 54, and thus provides sufficient force opposing coil spring 54 to keep the base of compression member 40 biased away from first support wall 22. The maximum stand-off of the base 40*e* from the support wall 22 is defined by the cam 34 and bearing plate 44 which are jammed against the head of shaft 48, which in turn is jammed against the support wall 22.

Figure 2B:
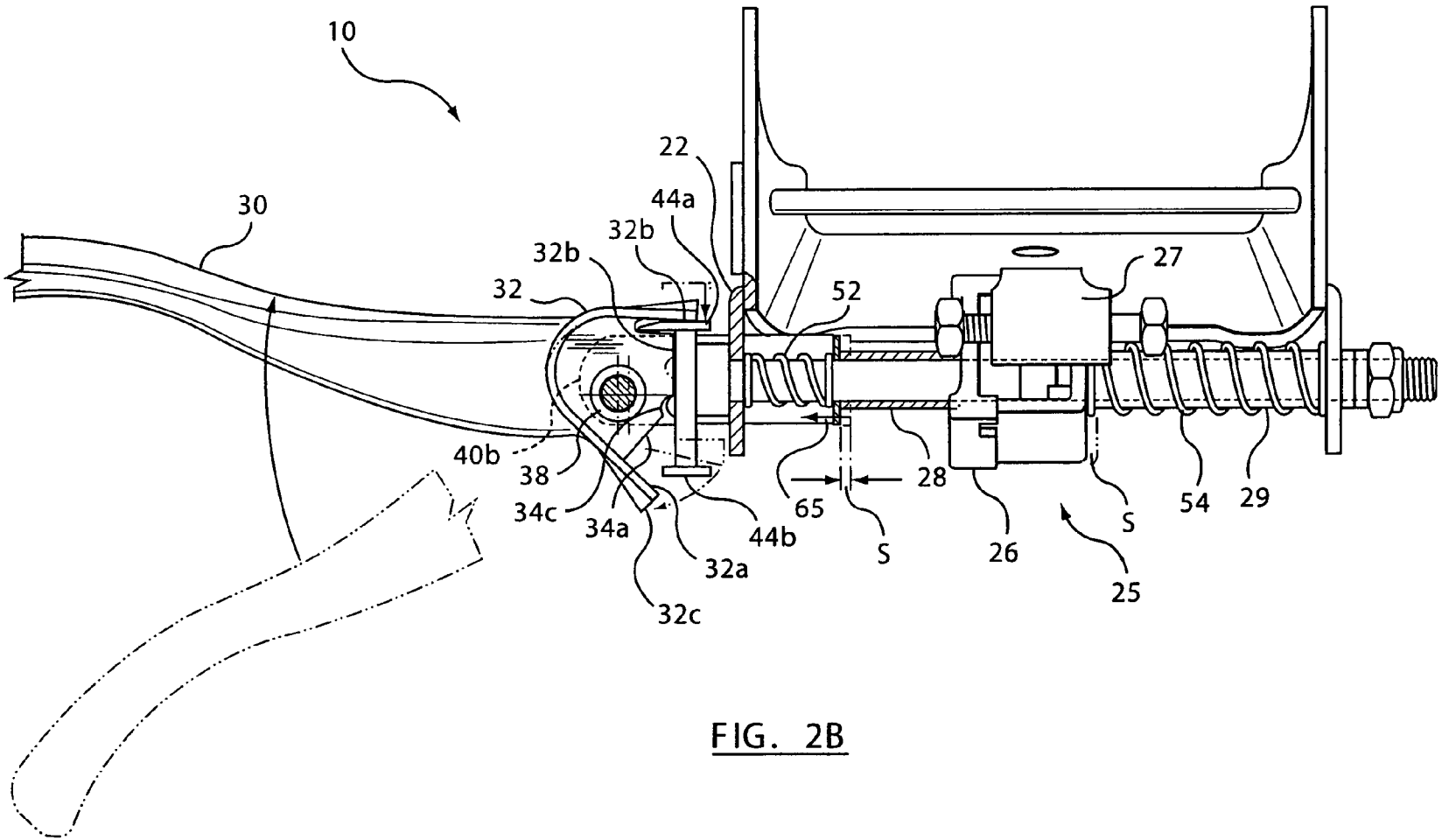
FIG. 2*b* is the chair adjustment mechanism of FIG. 2*a* in a second position.

Now referring to FIG. 2*b* along with FIG. 1*b* and FIG. 1*c*, the chair adjustment mechanism 10 of FIG. 2*a* is shown with handle 30 lifted to a second position. As shown, the movement of handle 30 by a user causes second cam face 34*b* to engage a second cam receiving surface 45*b* of bearing plate 44. As shown, the flanged extension 44*d* is received within the corresponding recess 34*d* in the second cam face 34*b*.

In the present illustrative embodiment, the notch 34*c* receives a cooperating protuberance 44*c* in bearing plate 44 and this joint is maintained as handle 30 is moved from one position to another. Thus, as a result of this joint, bearing plate 44 is slid down as the handle 30, and cam 34, are rotated to the second position shown in FIG. 2B.

Still referring to FIG. 2*b*, the movement of handle 30 into the second position causes the distance between the cam pivot (i.e. pin 38) and bearing plate 44 to be defined by the second cam face 34*b*. In the present illustrative embodiment, second cam face 34*b* causes the pivot pin 38 to move further away from bearing plate 44 than when first cam face 34*a* engages bearing plate 44. Thus, compression member 40 is pulled outwardly, in the general direction of arrow 65. The length of the stroke of compression member 40 is determined by the difference in distances from first cam face 34*a* to pivot pin 38, and second cam face 34*b* to pivot pin 38. In the present illustrative example, the length of the stroke of compression member 40 is indicated at S. This movement of compression member 40 also has the effect of compressing first coil spring 52 by the same distance S. Also, by action of coil spring 54 which extends by the same distance S, the slidable base 26 of locking assembly 25 slides towards first support wall 22 by the same distance S. However, the transversely mounted adjustment arm 27 does not move in relation to first support wall 22 (assuming that the adjustment arm 27 is non-slideably connected at its other end to another chair adjustment mechanism component). This relative movement between the slidable base 26 and transversely mounted adjustment arm 27 of locking assembly 25 may have the effect, for example, of engaging or disengaging a clutch mechanism (not shown) formed between the slidable base 26 and adjustment arm 27. Thus, for example, FIG. 2*a* may illustrate a locked position wherein the transversely mounted adjustment arm 27 is locked relative to the slidable base 26, and FIG. 2*b* may illustrate a corresponding unlocked position.

Figure 3:
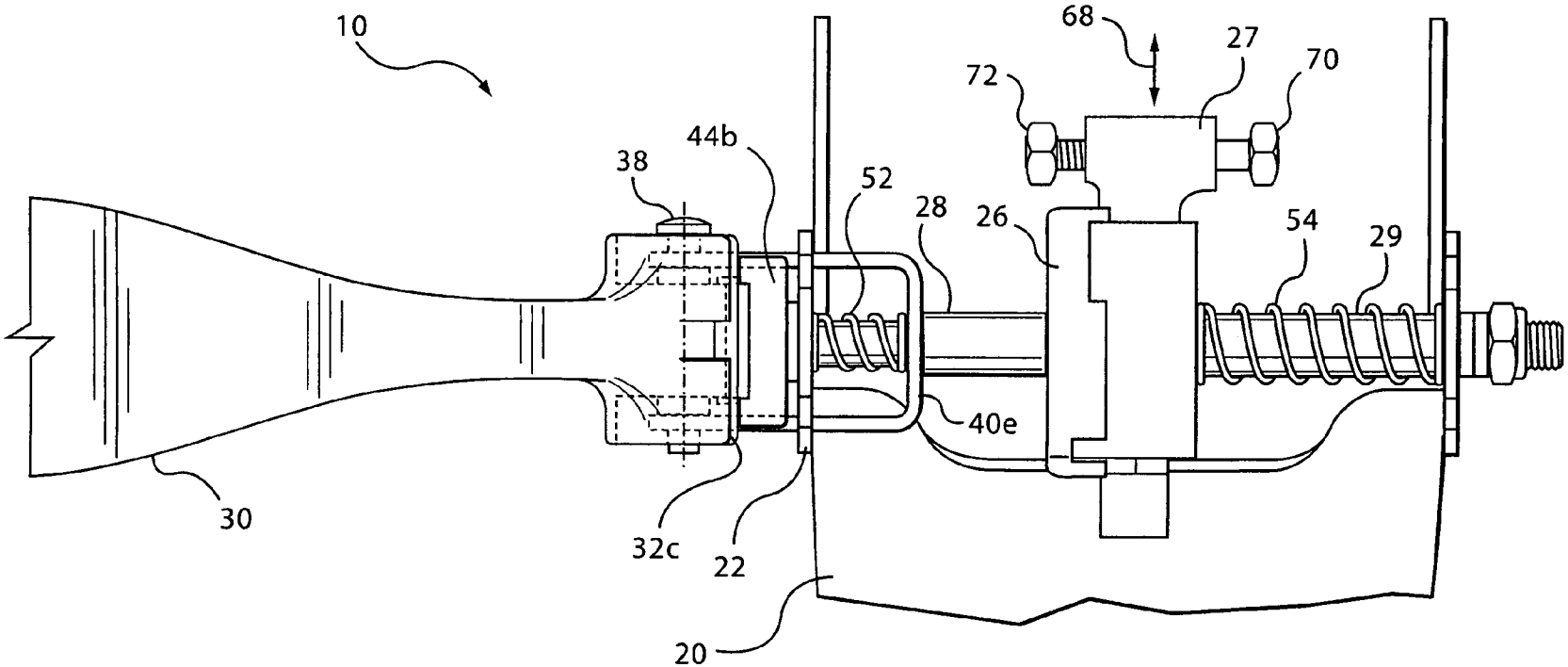
FIG. 3 illustrates a partial underside elevation of the chair adjustment mechanism of FIG. 2*b*.

Referring to FIG. 3, the chair adjustment mechanism 10 of FIG. 2*b* is now shown in an underside elevation view with bi-directional arrow 68 showing a possible movement of adjustment arm 27 relative to slidable base 26 when the slidable base 26 is in an unlocked position. For clarity, only a portion of the adjustment arm 27 is shown in FIG. 3. In operation, the adjustment arm 27 may be coupled to another chair bracket component by, for example, mounting bolt 70 and matching nut 72.

Bearing plate 44 provided between the cam 34 and the abutment 46 avoids sliding engagement between cam faces 34*a*, 34*b* and abutment 46. Instead, cam faces 34*a*, 34*b* engage the bearing plate 44 in a rocking manner about notch 34*c* so that it is the opposite surface of the bearing plate 44 that bears the brunt of the wear as it slidingly engages the abutment 46. In this regard, the second face of bearing plate 44 should be made sufficiently smooth so as to facilitate smooth sliding of bearing plate 44 against abutment 46, and be made sufficiently hard to resist wear. Even as the bearing plate 44 wears down, it does not reduce the ability of the mechanism to switch between positions. In other words, since it is the cam 34 that provides the key positional information for handle 30 and the adjustment mechanism 25, it will be appreciated that wear of the bearing plate 44 is less critical than wear of the cam 34. Further, even should the bearing plate wear out, it would be less expensive to replace than the handle 30 and cam 34.

In the present illustrative embodiment, the base 32 of handle 30 has flanged extensions 32*a*, 32*b* which reduce the risk of pinched fingers.

An advantage of transversely mounting the adjustment arm 27 to the slidable base 26 of the locking assembly 25 is that the force necessary to arrest the motion in the directions indicated by bi-directional arrow 68 is not translated to the switching apparatus (since a force in the direction of bi-directional arrow 68 is substantially perpendicular to shaft 48). Rather, the forces that bear on cam 34 and bearing plate 44 are largely provided by first coil spring 52 and second coil spring 54. The light switching action made possible by limiting the magnitude of forces to that necessary to slide the slidable base 26 of locking assembly 25 in and out of locking position relative to the adjustment arm 27 also reduces wear on the first and second cam faces 34*a*, 34*b* and notch 34*c*, and on the bearing plate 44.

Figure 4:
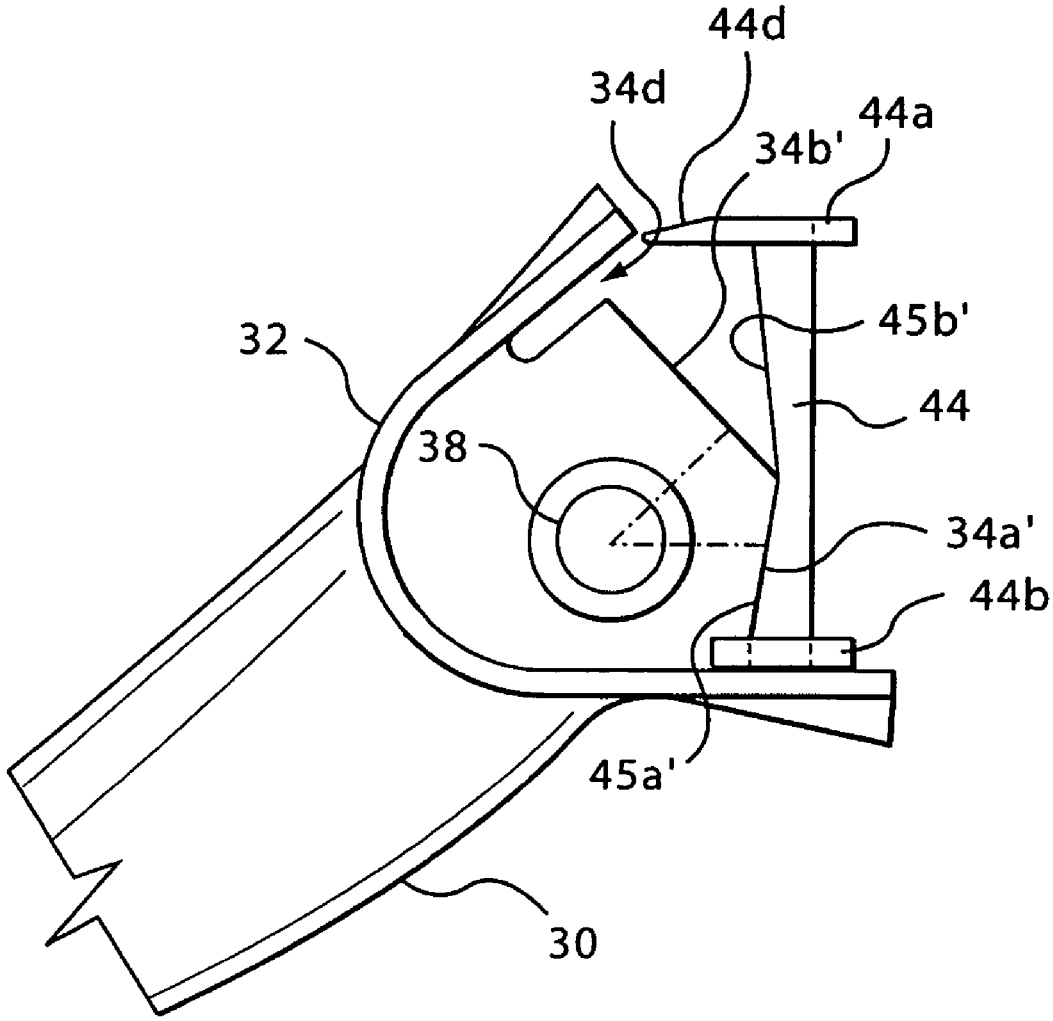
FIG. 4 illustrates an alternative embodiment of a switching apparatus made in accordance with the subject invention.

While the present illustrative embodiment shows a notch 34*c* provided in cam 34 which cooperates with protuberance 44*c* provided on bearing plate 44, this specific joining arrangement is not necessary. For example, rather than having a substantially flat cam receiving surface on the bearing plate 44, the surface of bearing plate 44 could be slightly angled to form a shallow V-shaped valley having first and second cam receiving surfaces, as seen in FIG. 4 at 45*a*', 45*b*', First and second cam faces 34*a*', 34*b*' could then define a cooperating angled cam face, without notch 34*c*, which rocks between the walls of the V-shaped valley formed by the first and second cam receiving surfaces 45*a*', 45*b*', In this case, the entirety of the V-shaped valley in bearing plate 44 can be characterized as an indentation, and the apex between the first and second cam faces 34*a*', 34*b*' can be characterized as forming a protuberance. It will be apparent to those skilled in that art that various other embodiments are possible to substantially prevent sliding between the cam 34 and the bearing plate 44 while the opposite side of bearing plate 44 slidingly engages abutment 46.

Also, while the present illustrative embodiment describes a rotatable member or cam having two faces, it will be apparent to those skilled in the art that more than two faces may be provided (e.g. three faces), such that there are a corresponding number of rotational positions of the rotatable member which define a corresponding number of different distances from the pivot. This may be useful if more than two positions are required for controlling an associated adjustment or locking mechanism.

Furthermore, in an alternative illustrative embodiment, spacers 28, 29 may be integrated with the design of the compression member 40 and/or the slidable base 26 of locking assembly 25. If the compression member 40, spacer 28, and slidable base 26 are functioning as an integrated unit, the second coil spring 54 may be omitted.

Although springs are used throughout the above disclosure, other resilient members may be used in place of springs, such as resilient clips.

While the switching apparatus has been described as operating a clutch arrangement, (comprising the slidable base 26 and adjustment arm 27) it will be appreciated that the switching apparatus may be employed to operate any variety of mechanisms.

The cam faces 34*a*, 34*b*, when flush against the bearing plate 44, naturally act as a stop. In consequence, it will be apparent that the flanges 44*a*, 44*b* of the bearing plate 44, which act as auxiliary stops, may, in some situations, not be needed.

The switching apparatus could function even if the cam 34 did not have faces which abutted the bearing plate 44 to define limit stops for cam rotation, provided the switching apparatus had some other cam stop, such as cam flanged extensions 32*a*, 32*b* hitting a respective flanged end 44*a*, 44*b* of the bearing plate 44.

Other modifications will be apparent to those skilled in the art and, therefore, the invention is defined in the claims.

What is claimed is:

1. A chair adjustment mechanism, comprising:

a cam rotatably fixed on a horizontal pivot;

a vertically slidable bearing member having a surface engaging said cam and an opposite surface slidably engaging an abutment such that said bearing member slides along said abutment when sliding vertically;

one of said pivot and said abutment being horizontally slidable;

a compression member arranged to bias said cam against said slidable bearing member, and said slidable bearing member against said abutment;

wherein, one of said cam and said slidable bearing member includes a protuberance, and the other of said cam and said slidable bearing member includes a corresponding indentation which forms a joint with said protuberance such that rotation of said cam causes said bearing member to slide vertically along said abutment.

2. The chair adjustment mechanism of claim 1, further comprising a compression member ananged to bias said cam against said slidable bearing member, and said slidable bearing member against said abutment.

3. The chair adjustment mechanism of claim 2, wherein a support wall retains said abutment in position.

4. The chair adjustment mechanism of claim 3, wherein said compression member receives said pivot and is biased relative to said support wall so as to bias said cam against said slidable bearing member, and said slidable bearing member against said abutment.

5. The chair adjustment mechanism of claim 4, wherein said compression member is biased away from said support wall by a spring.

6. The chair adjustment mechanism of claim 4, wherein said compression member is moveable by rotation of said cam and said compression member is arranged to switch a mechanism upon such movement.

7. A chair adjustment mechanism comprising:

a rotatable cam;

a first limit stop defining a first rotation limit of said cam and a second limit stop defining a second rotation limit of said cam;

a slidable bearing member perpetually bearing against said cam;

one of said cam and said slidable bearing having a protuberance, and the other of said cam and said slidable bearing having a corresponding indentation;

said sliding bearing member sliding in a direction such that, when said cam is (i) at said first rotation limit, (ii) at said second rotation limit, and at each of all possible positions between said first rotation limit and said second rotation limit, said protuberance extends within said indentation.

8. A chair adjustment mechanism of claim 7 wherein said join comprises an indentation in one of said cam and said bearing member and a protuberance on the other of said cam and said bearing member, said indentation receiving said protuberance.

9. A chair adjustment mechanism of claim 8 wherein said cam has a nose, said one of said indentation and said protuberance being located at said nose.

10. The chair adjustment mechanism of claim 9 further comprising an abutment perpetually bearing against a side of said bearing member opposite said cam, translation of said bearing member resulting in said bearing member sliding against said abutment member.

11. The chair adjustment mechanism of claim 10 wherein said bearing member is a bearing plate.

12. The chair adjustment mechanism of claim 11 wherein when said cam is in said first position, a first cam face abuts said bearing plate and when said cam is in said second position, a second cam face abuts said bearing plate, said nose being between said first cam face and second cam face.

13. The chair adjustment mechanism of claim 7 wherein said cam is rotatably fixed on a pivot.

14. The chair adjustment mechanism of claim 13 wherein said bearing member has a surface engaging said cam and an opposite surface slidingly engaging an abutment.

15. The chair adjustment mechanism of claim 14, further comprising a compression member arranged to perpetually bias said cam against said bearing plate, and said bearing plate against said abutment.

16. The chair adjustment mechanism of claim 15, wherein a support wall retains said abutment in position.

17. The chair adjustment mechanism of claim 16, wherein said compression member receives said pivot and is biased relative to said support wall so as to bias said cam against said bearing plate, and said bearing plate against said abutment.

18. The chair adjustment mechanism of claim 17, wherein said compression member is biased by a spring.

19. The chair adjustment mechanism of claim 17, wherein said compression member is moveable by rotation of said cam and said compression member is arranged to switch a mechanism upon such movement.

20. The chair adjustment mechanism of claim 14, wherein said bearing member comprises a slidable bearing plate.

21. The chair adjustment mechanism of claim 20, wherein said cam includes first and second cam faces and said first rotational position is defined by engagement of one of said first and second cam faces with said slidable bearing plate, and said second rotational positions is defined by engagement of the other of said first and second cam faces with said slidable bearing plate.

22. The chair adjustment mechanism of claim 21, further comprising a compression member arranged to bias said cam against said slidable bearing plate, and said slidable bearing plate against said abutment.

23. The chair adjustment mechanism of claim 22, wherein a support wall retains said abutment in position.

24. The chair adjustment mechanism of claim 23, wherein said compression member receives said pivot and is biased relative to said support wall so as to bias said cam against said bearing plate, and said bearing plate against said abutment.

25. The chair adjustment mechanism apparatus of claim 24, wherein said compression member is moveable by rotation of said cam and said compression member is ananged to switch a mechanism upon such movement.

26. The chair adjustment mechanism of claim 20, wherein said slidable bearing plate includes first and second edge stops which are configured to define sliding limits for said slidable bearing plate.

27. The chair adjustment mechanism of claim 26, further including first and second cam stops, one of said first and second cam stops being arranged to define a first rotational limit for said cam by engaging one of said first and second edge stops of said bearing plate, and the other of said first and second cam stops being arranged to define a second rotational limit for said cam by engaging the other of said first and second edge stops of said bearing plate.

28. The chair adjustment mechanism of claim 26, wherein at least one of said first and second edge stops of said bearing plate includes a flanged extension extending towards said cam and said cam includes a coffesponding recess to receive said flanged extension, said flanged extension dimensioned to substantially guard any gap formed between said bearing plate and said cam.

* * * * *